United States Patent [19]

Cartwright

[11] 3,948,078

[45] Apr. 6, 1976

[54] THERMAL ISOLATION MOUNTING FOR DRAWN AND WALL IRONING RAM

[75] Inventor: William John Cartwright, Palos Park, Ill.

[73] Assignee: Continental Can Company, Inc., New York, N.Y.

[22] Filed: May 12, 1975

[21] Appl. No.: 576,513

[52] U.S. Cl. ..... 72/456; 100/93 P

[51] Int. Cl.[2] ..... B21J 13/04

[58] Field of Search ..... 72/456, 455, 347, 349, 72/350, 351; 113/7; 100/93 P, 38

[56] References Cited

UNITED STATES PATENTS

| | | | |
|---|---|---|---|
| 1,889,320 | 11/1932 | Peters | 72/456 |
| 3,261,197 | 7/1966 | Weyer | 72/456 |
| 3,353,394 | 11/1967 | Smith | 72/347 |
| 3,735,629 | 5/1973 | Paramonoff | 72/349 |

*Primary Examiner*—C. W. Lanham
*Assistant Examiner*—Gene P. Crosby
*Attorney, Agent, or Firm*—John J. Kowalik; Joseph E. Kerwin; William A. Dittmann

[57] ABSTRACT

A mounting for a long horizontally disposed reciprocal ram of a can forming machine. The ram which carries a punch or mandrel at one end and is connected to a reciprocating drive at its other end is supported intermediate its ends from the machine framework by a plate which slides in a guideway. The plate, which extends parallel to the ram longitudinally thereof has a fixed connection at one end with the ram which is suspended beneath the plate. The plate which runs on guideways becomes very hot and is free to expand longitudinally independently of the ram since it has creep-accommodating connections through high thermal resistors with the ram at longitudinally spaced points which freely permit such expansion and resist transmission of heat into the ram.

10 Claims, 4 Drawing Figures

THERMAL ISOLATION MOUNTING FOR DRAWN AND WALL IRONING RAM

DISCUSSION OF THE PRIOR ART

In can making equipment wherein a mandrel draws and irons a metal blank through suitable drawing and ironing rings, it is mandatory to control thermal characteristics of the cooperating parts to very close tolerances inasmuch as can bodies are now being made extremely thin and the metal must be uniformly distributed about the entire cylindrical body portion so that it is mandatory to maintain the parts initially in closest tolerance and in alignment. Mandatory care is taken to preheat such machines to operating temperature and localized areas of wide ranging thermal gradients cannot be tolerated. It has been found, for example, that by welding the guideway support to the long ram, the support would become excessively heated and the thermal gradient which would develop between the support and the ram would cause the support to wrap, thus destroying the structure. A typical type of apparatus to which the invention is applicable is shown in U.S. Pat. No. 3,735,629.

SUMMARY OF THE INVENTION

This invention is directed to a novel thermally stable mounting for a ram of a can making machine.

A more specific object of the invention is to provide a mounting as above described which is allowed to expand freely from a single area of rigid connection to allow the heat-generating slidably supported rubbing portion of the ram structure to expand and contract independently of the supported portion.

A further object is to provide a novel mounting in which the heat generating supporting structure is thermally isolated from the supported structure and wherein the load carrying connections therebetween accommodate independent thermal expansion and contraction of the structures relative to each other.

These and other objects and advantages inherent in and encompassed by the invention will become more readily apparent from the specification and the drawings, wherein.

DESCRIPTION OF THE INVENTION

Figures 1, 2, 3, 4:
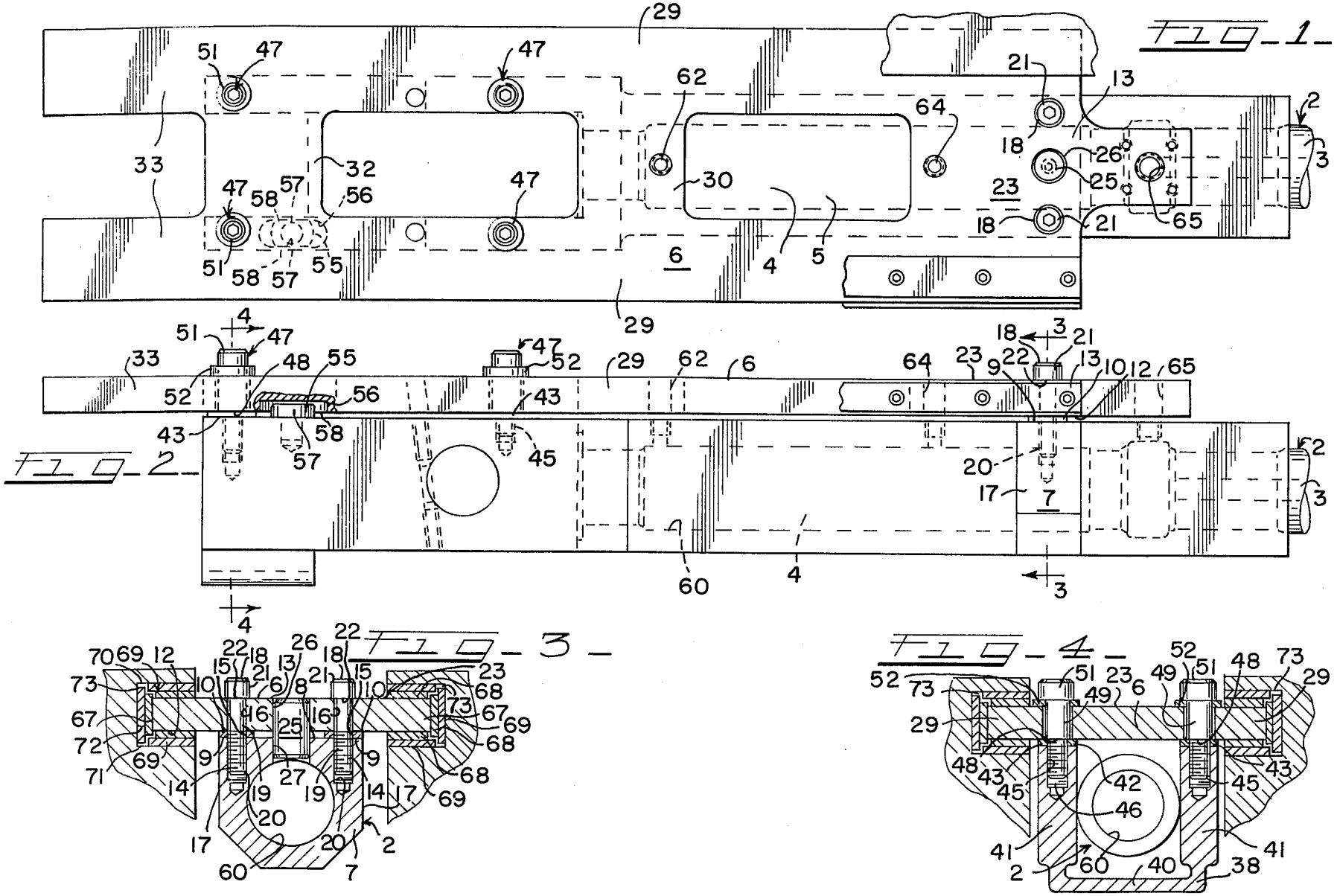
FIG. 1 is a top plan view of the novel thermal mounting assembly.
FIG. 2 is a side elevational view of the assembly.
FIG. 3 is a cross-sectional view taken substantially on line 3—3 of FIG. 2.
FIG. 4 is a cross-sectional view taken substantially on line 4—4 of FIG. 2.

The invention is shown in association with a can making machine which has a ram 2 (only a portion of which is shown) adapted for longitudinal reciprocation as well known in the art.

The distal end of the leading position 3 of the ram is provided with a punch or mandrel which supports the can blank and moves through a series of dies (now shown).

The trailing end portion 4 of the ram is formed as a hollow air accumulator tube or container 5 which is suspended beneath a slide plate 6.

The forward end portion 5a of the tube 5 is formed with a mounting block 7 having an upper planar mounting surface 8 which affords a flat face seat at 9, 9 for the bottom sides of washers 10, 10 made of high thermal resistance material such as stainless steel. The flat upper faces of these washers 10 seat against a flat bottom surface 12 of the slide plate 6 and serve to thermally isolate the adjacent leading end portion 13, the plate from the ram 2. There are formed two openings 14, 14 in the block portion 7 of the ram which are in vertical alignment with openings 15 in the respective washers and openings 16, 16 formed in the leading end portion 13 of the slide plate. These openings 15, 15 are spaced widthwise of the plate and are equally spaced from the opposite sides 17, 17 of the block 7. A pair of close fitting bolts 18, 18 have shanks 19 extending through respective aligned openings 14, 15 and the shanks have threads at their lower ends threaded into the threads 20 formed in the openings 14. The upper ends of the shanks are formed with bolt heads 21 which have shouldered engagement at 22 with the flat top side 23 of the plate 6 drawing the parts tightly together.

The bolts 18 flank a securing pin 25 centered therebetween, the pin 25 being tightly press-fitted into vertically aligned openings 26, 27 formed respectively in the plate portion 13 and the forward end block 7 of the ram body section 5. The assembly of the bolts 18 and the pin 25 provides a single fixed anchor means for the plate to the ram in one localized area at the leading end of the plate portion 13.

The plate portion 13 is a skeletal element of one-piece construction having a pair of laterally spaced parallel side legs 29, 29 which are interconnected at their front ends by the portion 13 of the plate, said portion 13 serving as a cross-member or bridge between the legs 29, 29.

The legs 29, 29 are interconnected intermediate their ends, approximately centrally thereof, by an integral tie bar, bridge or cross-member 30 and are interconnected by an integral tie bar, bridge or cross-member 32 adjacent to their trailing or rear ends 33, 33.

The bridge members form with the legs a plurality of vent openings 34, 35, 36 and thermal equalizers 13, 30 and 32 between the legs serve to transmit heat therebetween.

The rear end portion of the ram body section 5 is formed with a U-shaped stirrup-like mounting section 38 which comprises a lower cross wall 40 and upright side walls 41, 41 which at their upper ends are formed with horizontal coplanar faces 42 each of which seats against the bottom flat side of a high resistance (low thermal conductively) washer 43 which may be made of stainless steel, for example. Each washer 43 has a flat upper face seated against the flat undersurface 12 of the mounting or support plate 3.

The side walls 41, 41 are provided with threaded bores 45, 45 into which are threaded the lower threaded ends of shank portions 46, 46 of high thermal resistance bolts 47 made of stainless steel. The shank of each bolt 47 has a shoulder 48 intermediate its ends having shouldered engagement with the top side of the associated washer 43.

The enlarged shank portions 49 of each bolt 47 extends through an oversize opening 50 in the plate 13 and at its upper end has a head 51 which bears against the top side of a high thermal resistance washer 52 of stainless steel, the bottom side of the washer 52 seating against the flat top surface 23 of the plate 13. It will be apparent that the shouldered engagement of the enlarged portions 49 of bolts 47 limits the plate to only slight pressure contact with the washers 52 to further minimize thermal conductivity between the plate 13 and the ram portion and also allows free expansion and contraction.

To maintain the plate 13 and ram section in longitudinal alignment a sine key 55 is secured to one of the walls 41 and projects above wall 41 into a guide slot 56 provided in the bottom of the plate 13 and elongated lengthwise of the plate thus uninhibiting longitudinal expansion and contraction of the plate. The sides 57, 57 of the key however, fit closely against the sides 58, 58 of the key way, thus inhibiting lateral displacement between the plate and ram. It will be noted that the plate is secured to the ram by only four thermal-creep accommodating bolt connections 47 and is controlled in its longitudal expansion and contraction by the sine key assembly 55–56 and that it only has a fixed driving connection only at its front end in a limited area by the bolts 18 and pin 25. The plate and ram thus can expand and contract independently of each other because of the temperature gradients that develop.

It will be noted that the ram portion 2 has a base which provides an air accumulator chamber 60. This chamber 60 has an inlet port 62 and an outlet port 64. Air is delivered into the chamber and exhausts by way of a valve (not shown) into the passageway 65 in a mandrel-portion 3 of the ram, said mandrel portion 3 having at its forward end (not shown) the can forming mandrel as well known to those skilled in the art. The passage of air through the chambered body portion of the ram also develops a temperature differential with respect to the mounting plate 13 which at its lateral edges 67, 67 is provided with wear strips 68 which ride along and upon opposing strips 69, secured to the top and bottom and vertical sides 70, 71, 72 of the slide ways or slots 73, 73 provided in the frame structure of the apparatus.

In operation, the ram and plate is reciprocated and the friction between the plate and supporting frame generates a large quantity of heat which is transmitted to the plate. The plate expands lengthwise primarily and since such is unrestricted it does not affect the expansion of the tube portion of the ram therebeneath. Very little, if any, heat is conducted from the plate. Excess heat in the plate dissapates through the vent openings and by conduction into the frame of the machine.

It will be seen that the front tongue like portion 75 of the plate projects forwardly of the fixed anchor area and provides a support for an air valve (not shown).

A novel and effective means has been provided to prevent warping of the connected parts and which is durable and relatively inexpensive.

What is claimed is:

1. In a can making machine, a frame, a reciprocal ram assembly comprising a generally horizontally disposed section, a plate section disposed in superposed relation to the ram section, said plate section being elongated lengthwise of the ram section, a slideway on the frame, said plate section housing edge portions slidably mounted in said slideway, said slideway and edge portions being in frictional heat generating engagement with each other, means fixedly securing said plate section to the ram section in a single area whereby said sections are accommodated by unrestricted expansion and contraction independently of each other and heat transfer therebetween is minimized.

2. The invention according to claim 1 and said fixed connection comprising a single pin press fitted into aligned openings in said sections.

3. The invention according to claim 1 and high thermal resistance slidable connections between said sections spaced longitudinally from said fixed connection.

4. The invention according to claim 3 and interfitting alignment means on said sections for limiting lateral movements therebetween and providing means accommodating relative longitudinal expansion therebetween.

5. The invention according to claim 3 and said slidable connections comprising high thermal resistance bolts threaded into one of said sections and extending through enlarged openings in the other of the sections of a size sufficient to accommodate relative thermal creep therebetween.

6. The invention according to claim 5 and said bolts being made of stainless steel.

7. In a metal forming apparatus of the type having a main frame mounting a longitudinally reciprocal ram, the following improvement:

a thermally controlled mounting for the ram comprising a plate, a slideway on the main frame receiving opposite edges of said plate, a localized fixed thermally conductive connection between one end of the plate and said ram, and means of high thermal resistance providing slidable connections between the plate and ram at locations spaced from said fixed connection lengthwise and widthwise of the plate.

8. The invention according to claim 7 wherein said plate is of skeletal construction and comprises a pair of laterally spaced continuous legs along the sides of the plate and a plurality of cross-members spaced lengthwise of the plate integral with the legs and defining air vent passages therebetween.

9. The invention according to claim 8 and said ram comprising a heat dissapating hollow section in transverse alignment with said plate for accumulating and discharging air disposed in alignment with said vent passages, said plate overlying said ram section and said vents accommodating passage of thermal currents therethrough.

10. The invention according to claim 9 and key and slot means interconnecting the ram and plate for guiding expansion and contraction thereof.

* * * * *